United States Patent [19]

Liebe et al.

[11] Patent Number: 4,621,216

[45] Date of Patent: Nov. 4, 1986

[54] HIGH-PRESSURE DISCHARGE LAMP WITH SHIELDED ELECTRODE

[75] Inventors: Johan Liebe; Andreas S. G. Geven; Antonius J. G. C. Driessen; Jan R. deBie, all of Eindhoven, Netherlands

[73] Assignee: U.S. Philips Corporation, New York, N.Y.

[21] Appl. No.: 602,852

[22] Filed: Apr. 23, 1984

[30] Foreign Application Priority Data

Apr. 22, 1983 [NL] Netherlands ..... 8301418

[51] Int. Cl.[4] ..... H01J 61/06; H01J 61/36

[52] U.S. Cl. ..... 313/613; 313/623; 313/631

[58] Field of Search ..... 313/631, 623, 624, 625, 313/613, 614, 616, 626, 628

[56] References Cited

U.S. PATENT DOCUMENTS

| | | | |
|---|---|---|---|
| 3,809,943 | 5/1974 | Collins et al. | 313/623 |
| 3,851,207 | 11/1974 | McVey | 313/550 X |
| 3,911,313 | 10/1975 | Makar, Jr. | 313/631 X |
| 4,150,317 | 4/1979 | Laska et al. | 313/631 |
| 4,160,930 | 7/1979 | Driessen et al. | 313/631 X |
| 4,396,856 | 8/1983 | Ogata et al. | 313/616 X |

FOREIGN PATENT DOCUMENTS

| | | | |
|---|---|---|---|
| 107110 | 4/1939 | Australia | 313/631 |
| 982646 | 1/1976 | Canada | 313/626 |
| 4383 | 1/1978 | Japan | 313/628 |
| 17550 | 1/1982 | Japan | 313/631 |
| 1015506 | 1/1966 | United Kingdom | 313/623 |

*Primary Examiner*—Palmer C. DeMeo

*Attorney, Agent, or Firm*—Emmanuel J. Lobato

[57] ABSTRACT

The invention relates to a high-pressure discharge lamp having a discharge envelope (3) with a ceramic wall provided with at least one electrode (4). The electrode (4) comprises a rod (41) which is connected to a tubular lead-through member (40) and on which an emitter-containing element (42) is arranged. By means of a screening body (43), the emitter-containing element (42) is screened on its outer side. According to the invention, the screening body (43) extends with a constant cross-section from the tubular lead-through member (40) to the end of the emitter-containing element (42) facing the discharge path. Thus, an improved temperature control is obtained within the discharge envelope (3) during operation of the lamp.

18 Claims, 3 Drawing Figures

HIGH-PRESSURE DISCHARGE LAMP WITH SHIELDED ELECTRODE

BACKGROUND OF THE INVENTION

The invention relates to a high-pressure discharge lamp comprising a discharge envelope enclosing a discharge space with a ceramic wall and provided with a pair of electrodes between which extends a discharge path. At least one electrode is provided with a rod which is connected to a tubular lead-through member and on which is arranged an emitter-containing element which is screened from the discharge space by means of a screening body. The expression "ceramic wall" is to be understood herein to mean a wall of monocrystalline oxide, such as, for example, sapphire, or of a polycrystalline oxide, such as for example, densely sintered aluminium oxide.

Such a lamp electrode is known from U.S. Pat. No. 3,911,313. In this case, the lead-through member and the screening body are made in one piece and the electrode rod is fixed by means of a restriction of the screening body with respect to the screening body by means of solder. At the area of the emitter-containing element, the screening body has a widened cross-section. The restriction further has for its object to position the emitter-containing element.

Further, structure is generally known in which the emitter-containing element is comprised of a first coil winding which is separated from the discharge space by a second coil winding at the area of the first coil winding (see, for example, U.S. Pat. No. 4,152,620).

In many types of high-pressure discharge lamps (the saturated vapor discharge lamp), one or more constituents of the filling of the discharge envelope are present in excess quantities. This results in the pressure of such a constituent during operation of the lamp being determined by the temperature at the area at which the filling constituent is present in excess quantity. The area at which the excess quantity of the relevant filling constituent is present in the so-called coldest spot or simply "cold spot" and is generally located near a lead-through member of the discharge envelope.

A general problem in such lamps is that due to an excessively low temperature of the coldest spot the pressure of the filling constituent present in excess quantity is lower than is desirable. The invention provides means by which this problem is avoided or at least mitigated. Another problem occurs when the coldest area is constituted in part by the lead-through member. In this case, there is a risk of the discharge directly applying to the excess filling.

SUMMARY OF THE INVENTION

According to the invention, for this purpose a high-pressure discharge lamp of the kind mentioned in the opening paragraph is characterized in that the screening body extends with a constant cross-section from the tubular lead-through member to the end of the emitter-containing element facing the discharge path and is in mechanical contact with the tubular lead-through member over substantially its whole cross-sectional area.

An advantage of the invention is that improved heat conduction is obtained between the electrode and the tubular lead-through member. Consequently, the temperature of the ceramic wall of the discharge envelope is increased at the area of the lead-through member. The tubular form of the lead-through member then ensures that the heat transport is continued along the whole lead-through, as a result of which excessive local heating of the ceramic wall material is prevented. Although the screening body constitutes a comparatively large radiating surface, as a result of which the temperature of the direct environment is also increased due to direct heat radiation, it has been found that the influence of radiation is certainly ten times smaller than the influence of heat conduction. From a constructional point of view the invention further has the advantage that it is extremely simple. An additional advantage is that the screening body also screens the connection between the electrode rod and the lead-through member from any attack of the discharge arc.

It is known from U.S. Pat. No. 3,851,207 to use an electrode construction for a high-pressure discharge lamp in which a part of an electrode coil winding is constructed as a heater coil. In order that the coil acts as a heater coil, it is required that the length and the diameter of the coil wire are suitably dimensioned, which in practice leads to a comparatively complicated construction. General teaching has shown that requirements for the operation as a heater coil are in conflict with requirements for good heat conduction, which results in the known coil construction necessarily having less favorable heat-conduction properties.

Another known means for influencing the temperature of the coldest spot uses a metal heat shield arranged around the discharge envelope. Besides the complexity of the construction, this measure has the further disadvantage of poor reproducibility. Moreover, it is frequently found that the voltage differences between the heat shield and the discharge space lead to migration of filling constituents through the wall of the discharge envelope.

In order to increase the temperature of the coldest spot, it is alternatively possible to choose the distance between the end of the discharge envelope and the electrode tip to be smaller. However, smaller dimensions require the mechanical tolerances to be more stringent, which leads to a manufacture which is generally more difficult and hence more expensive. This is a disadvantage. Besides, the disadvantage occurs, especially in lamps having a power of 100 W or lower, where the space available for storing the required quantity of the filling constituents present in excess becomes so small that the excess constituents are in direct contact with the electrode in case the lamp is out of operation. When the lamp is started, this leads in practice to problems, such as the application of the discharge arc to the filling constituents present in excess.

Preferably, in a lamp according to the invention, the screening body tightly surrounds the electrode rod at the end facing the discharge path. Thus, sputtering of material of the emitter-containing element is prevented. This is of particular importance during the starting stage of the lamp. Preferably, the distance between the electrode rod and the tightly fitting screening body is not larger than 150 $\mu$m throughout the circumference. In the case of nominal lamp powers lower than 100 W, the said distance is preferably chosen to be smaller.

In an embodiment of a lamp according to the invention, the screening body is a wire coil whose turns abut each other. In another embodiment, however, the screening body is a sleeve of which the end facing the discharge has an opening through which the electrode rod is passed.

Both embodiments have the advantage that the emitter-containing element is screened satisfactorily, as a result of which evaporation and sputtering of material are prevented or at least very strongly reduced. Evaporation and sputtering of material are reduced because it has been found that such material is generally deposited on the wall of the discharge envelope and thus leads to blackening of the wall. Further, the material deposited on the wall plays an important part in chemical reactions between lamp filling constituents and the wall material, which reactions result in life of the lamp shortened.

It is a surprise to find that by means of a screening body constituted by a niobium sleeve a satisfactory screening is obtained which is capable of withstanding for a long time the influence of the application of a discharge arc. Niobium has the advantage of a comparatively high ductility, as a result of which the sleeve can be manufactured comparatively simply.

Advantageously, the screening body is made of tungsten because tungsten has a high heat resistance and very favorable heat-conducting properties.

BRIEF DESCRIPTION OF THE DRAWINGS

An example of a lamp according to the invention will be described more fully with reference to the accompanying drawing, in which.

DETAILED DESCRIPTION OF THE INVENTION

Figure 1:
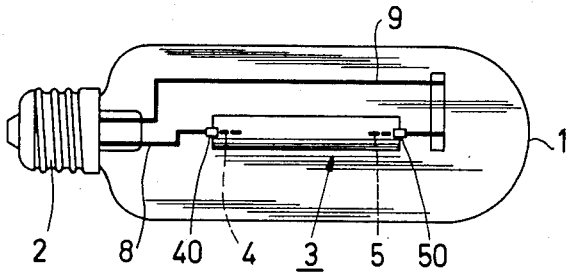
FIG. 1 is a side elevation of the lamp.

In FIG. 1, an outer bulb 1 of a lamp is provided with a lamp cap 2. The outer bulb encloses a discharge envelope 3, which encloses a discharge space, has a translucent ceramic wall, and is provided with a pair of electrodes 4, 5. A discharge path extends between the pair of electrodes. The electrode 4 is connected by means of a tubular, notably a sleeve-shaped, lead-through member 40 and a current-supply conductor 8 to a connection contact of the lamp cap 2. The electrode 5 is connected by means of a lead-through member 50 and a current-supply conductor 9 in an analogous manner.

Figure 2:
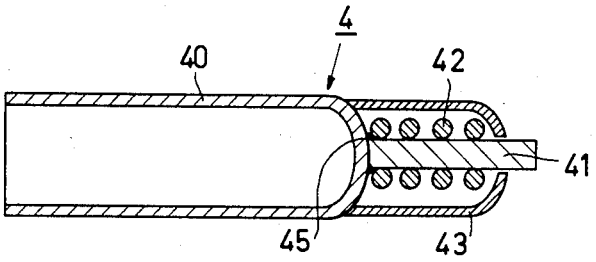
FIG. 2 shows in detail an electrode with a screening construction.

The electrode 4 is composed, as indicated in FIG. 2, of an electrode rod 41 which is connected by means of a soldered connection 45 to a sleeve-shaped lead-through member 40. An emitter-containing element in the form of a coil 42 provided with emissive material is arranged on the electrode rod 41. The coil 42 is screened from the discharge space by means of a sleeve-shaped screening body 43. The screening body 43 extends with a constant cross-section from the sleeve-shaped lead-through member 40 to the end of the emitter-containing body facing the discharge path and at this end tightly fits around the electrode rod, which is passed through an opening in the end of the sleeve facing the discharge. The screening body 43 is in mechanical contact with the sleeve-shaped lead-through member 40 substantially over its whole cross-sectional area. On the one hand, the sleeve-shaped lead-through member 40 is hermetically connected in a generally known manner, for example by means of sealing glass, to the ceramic wall of the discharge envelope and on the other hand the sleeve-shaped lead-through member 40 is electrically connected to the current-supply conductor 8.

Preferably, the sleeve 43 is welded to the sleeve-shaped lead-through member 40, for example, by means of spot-welding. Thus, the sleeve is fixed and hence the possibility is attained that the lamp can be arranged in any desired operation position.

Figure 3:
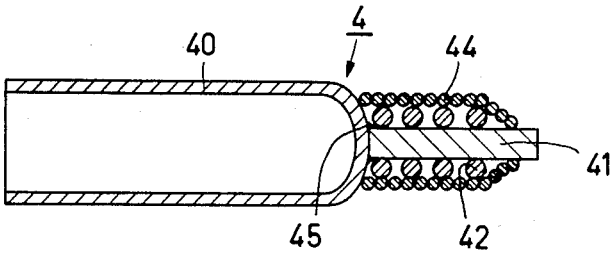
FIG. 3 shows a modification of the construction of an electrode with a screeing body.

In the modification of the electrode construction shown in FIG. 3, parts corresponding to those in FIG. 2 are provided with the same reference numerals. The screening body, which is in mechanical contact with the sleeve-shaped lead-through member 40 substantially over its whole cross-sectional area, is in this case a wire coil 44 whose turns abut each other. Also in this case, the screening body is fixed by means of a welding connection, for example, a spot weld to the electrode rod 41.

In one embodiment, the ceramic wall of the discharge envelope mainly consists of densely sintered aluminium oxide. The construction of the electrodes corresponds to that of FIG. 2. The lead-through members are niobium sleeves, just like the screening bodies, and are connected to each other by spot-welding. The electrode rods and the coils mainly consist of tungsten. Each screening body tightly fits around the electrode rod at the end facing the discharge. The distance between the electrode rod and the screening body is not more than 50 $\mu$m throughout the circumference. Each screening body encloses a coil provided with emissive material.

The filling of the discharge envelope consists of 5 mg of amalgam comprising 27% by weight of Na and 73% by weight of Hg and xenon which at 300 K. has a pressure of 73 kPa.

The discharge envelope has an inner length of 24 mm and an inner diameter of 3.5 mm. The distance between the electrode tips is 16 mm.

The lamp is suitable to be operated at a supply voltage of 220 V, 50 Hz, in combination with a stabilization ballast of 250Ω. The power dissipated by the lamp is 50 W during operation. The radiation emitted by the lamp during operation has a color temperature $T_c$ of 2450 K. and a value for the general color rendition index $R_a$ of 85, corresponding with a temperature of the coldest spot of 1150 K. Thus, the lamp described is suitable inter alia for interior illumination purposes.

Another practical lamp is provided with an electrode construction as shown in FIG. 3. The screening body is formed from a wire coil of tungsten, just like the electrode rod and its coil provided with an emitter. The turns of the screening wire coil abut each other and also abut the sleeve-shaped lead-through member made of niobium. At the end facing the discharge path, successive turns of the screening body are located on one line which encloses an angle of 45° with the longitudinal axis of the electrode rod, while the outermost turn is secure to the electrode rod by spot-welding.

This lamp, which is suitable to be operated at a supply voltage of 220 V, 50 Hz, dissipates a power of 100 W during operation. The inner length of the discharge envelope is 38 mm and the inner diameter is 4.8 mm. The distance between the electrode tips is 28.4 mm. The filling of the discharge envelope comprises 10 mg of amalgam, of which 73% by weight is Hg and 27% by weight is Na, and xenon having at 300 K. a pressure of 20 kPa. After an operating life of 100 hours, the lamp has a luminous efficacy $\eta$ of 55 lm/W, while the color temperature $T_c$ of the emitter radiation is 2500 K. and the general color rendition index $R_a$ is 85, the temperature of the coldest area $T_k$ being 1150 K. After 5000 operating hours, these values are $\eta=50$ lm/W; $T_c=2380$ K.; $R_a=80$; $T_k=1120$ K.

What is claimed is:

1. A high-pressure discharge lamp comprising a sealed discharge envelope with a ceramic wall enclosing a discharge space, containing vaporizable and ionizable fill and provided with a pair of electrodes between which a discharge path extends, at least one electrode being provided with a rod which is connected to a tubular lead-through member and on which an emitter-containing element is arranged which is screened from the discharge space by means of a screening body, characterized in that the screening body extends with a constant cross-section from the tubular lead-through member to the end of the emitter-containing element facing the discharge path and is in mechanical contact with the tubular lead-through member substantially over its whole cross-sectional area.

2. A lamp as claimed in claim 1, characterized in that the screening body fits tightly around the electrode at the end facing the discharge path.

3. A lamp as claimed in claim 1, characterized in that the screening body is a wire coil whose turns abut each other.

4. A lamp as claimed in claim 1, characterized in that the screening body is a sleeve of which the end facing the discharge has an opening through which the electrode rod is passed.

5. A lamp as claimed in claim 4, characterized in that the sleeve is made of niobium.

6. A lamp as claimed in claim 3, characterized in that the screening body is made of tungsten.

7. A lamp as claimed in claim 2, characterized in that the screening body is a wire coil whose turns abut each other.

8. A lamp as claimed in claim 2, characterized in that the screening body is a sleeve of which the end facing the discharge has an opening through which the electrode rod is passed.

9. A lamp as claimed in claim 8, characterized in that the sleeve is made of niobium.

10. A lamp as claimed in claim 4, characterized in that the screening body is made of tungsten.

11. In a high-pressure saturated vapor discharge lamp of the type having a closed ceramic wall discharge envelope, vaporizable and ionizable fill material within said discharge envelope that is partially vaporized and ionized during lamp operation to emit light, said fill material being present in an excess such that an amount of unvaporized fill material remains during lamp operation and the pressure of vaporized fill material during lamp operation is determined by the cold spot temperature of the discharge envelope, a pair of spaced discharge electrodes within said discharge envelope and energizable for establishing an electrical discharge therebetween, and a pair of conductive feed-throughs each extending through the wall of said discharge envelope and each connected to a respective one of said discharge electrodes for establishing electrical connections to said discharge electrodes, the improvement comprising:

one of said lead-throughs comprising a tubular lead-through extending into said discharge envelope and terminating at a closed end within said discharge envelope, the portion of said discharge envelope proximate said tubular lead-through comprising the cold spot of said discharge envelope and excess fill material present during lamp operation being within the cold spot region of said discharge envelope;

an electrode extending coaxially from said closed end of said tubular lead-through and terminating at a free end within said discharge envelope, and having means for retaining electrode emitter material; and a tubular screening body having a constant diameter portion extending coaxially from said closed end of said tubular member, said tubular screening member having one end of said constant diameter attached to and circumscribing said closed end of said tubular member for maximizing heat transfer from said screening body to said tubular lead-through and said screening body having a second end of reduced diameter proximate said free end of said electrode and closely surrounding said electrode for minimizing exposure of said electrode and said means for retaining electrode emitter material.

12. In a high-pressure saturated vapor discharge lamp according to claim 11, wherein said electrode is comprised of an electrode rod having one end connected to the closed end of tubular lead-through and extending coaxially with said lead-through and terminating at said electrode free end, and a coil wound around said electrode rod at a position between said lead-through and said electrode free end, and said coil constituting said means for retaining electrode emitter material.

13. In a high-pressure saturated vapor discharge lamp according to claim 11, wherein said screening body is comprised of a metal sleeve of constant diameter over a major portion of its length.

14. In a high-pressure saturated vapor discharge lamp according to claim 12, wherein said screening body is comprised of a metal sleeve of constant diameter over a major portion of its length with a first end of said constant diameter and a second end constricted with an opening diameter substantially equal to the diameter of said electrode rod, said metal sleeve disposed with said electrode extending axially through said sleeve and said electrode rod free and protruding from the opening in said sleeve constricted end portion and defining a gap between said electrode rod and said sleeve constricted end.

15. In a high-pressure saturated vapor discharge lamp according to claim 14, wherein the gap between said electrode rod and said sleeve constricted end is less than about 150 $\mu$m.

16. In a high-pressure saturated vapor discharge lamp according to claim 15, wherein the gap between said electrode rod and said sleeve constricted end is less than about 50 $\mu$m.

17. In a high-pressure saturated vapor discharge lamp according to claim 12, wherein said screening body is comprised of a metal coil closely wound with successive coil turns touching to define a continuous closed coil of constant diameter over a major portion of its length.

18. In a high-pressure saturated vapor discharge lamp according to claim 12, wherein said screening body is comprised of a metal coil closely wound with successive coil turns touching to define a continuous closed coil of constant diameter over a major portion of its length with a first end of said constant diameter and a second end constricted with an opening diameter substantially equal to the diameter of said electrode rod, said metal sleeve disposed with said electrode extending axially through said sleeve and said electrode free end protruding from the opening in said sleeve constricted end portion.

* * * * *